US006603244B2

(12) United States Patent
Sugiyama et al.

(10) Patent No.: US 6,603,244 B2
(45) Date of Patent: Aug. 5, 2003

(54) SPARK PLUG AND METHOD OF PRODUCING SPARK PLUG

(75) Inventors: Yoshihisa Sugiyama, Gifu (JP); Tomoharu Suzuki, Nagoya (JP); Kenichi Kumagai, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/082,068

(22) Filed: Feb. 26, 2002

(65) Prior Publication Data

US 2002/0158559 A1 Oct. 31, 2002

(30) Foreign Application Priority Data

Feb. 28, 2001 (JP) ..... 2001-053845

(51) Int. Cl.[7] ..... F02M 57/06; H01T 21/02
(52) U.S. Cl. ..... 313/118; 445/7
(58) Field of Search ..... 313/11.5, 118, 313/113 A, 145; 445/7

(56) References Cited

U.S. PATENT DOCUMENTS 4,144,474 A * 3/1979 Nishio et al. ..... 315/53
4,853,582 A * 8/1989 Sato et al. ..... 313/141
5,497,045 A * 3/1996 Matsutani et al. ..... 313/141
6,111,345 A * 8/2000 Shibata et al. ..... 313/141

FOREIGN PATENT DOCUMENTS

| | | |
|---|---|---|
| JP | 11-185928 | 7/1999 |
| JP | 2992891 | 10/1999 |
| JP | 2000-336446 | 12/2000 |

* cited by examiner

*Primary Examiner*—Don Wong
*Assistant Examiner*—Minh D A
(74) *Attorney, Agent, or Firm*—Sughrue Mion, PLLC

(57) ABSTRACT

A spark plug includes: a central electrode; an insulator surrounding the central electrode radially; a metallic shell surrounding the insulator radially; and a ground electrode having a first end connected to the metallic shell and a second end defining a side face. The ground electrode is so bent that the side face of the second end faces the central electrode. The ground electrode contains: a nickel in a range from 58% to 71% by weight, a chromium in a range from 21% to 25% by weight, an iron in a range from 7% to 20% by weight, and an aluminum in a range from 1% to 2% by weight. The ground electrode has a Vickers hardness in a range from Hv 140 to Hv 220 through a Vickers hardness test specified in Japanese Industrial Standard Z2244. A load 9.8 N is applied to the ground electrode in the hardness test.

16 Claims, 7 Drawing Sheets

SPARK PLUG AND METHOD OF PRODUCING SPARK PLUG

BACKGROUND OF THE INVENTION

The present invention relates to a spark plug used for an internal combustion engine. Moreover, the present invention relates to a method of producing the spark plug.

A spark plug is used for igniting an internal combustion engine of a motor vehicle and the like. For increasing engine output and reducing fuel consumption, temperature in a combustion chamber of the engine is likely to increase. For improving ignitability, a discharge portion of the spark plug is likely to protrude into the combustion chamber of the engine. Such type of engine is more and more increased in number. Under the above circumstance, the discharge portion of the spark plug is exposed to high temperature, thus causing failures (attributable to spark) such as wear, breakage and the like of the ground electrode.

Furthermore, as part of maintenance-free measures of the automotive engine, recently, durability of the spark plug is required with no replacement, for consecutive vehicle drive not less than 160,000 km or not less than 240,000 km (cumulative). To meet this requirement, the spark plug has the following metal: The central electrode and/or the ground electrode is made of a material having high heat conductivity such as Cu, Cu alloy, and the like (having heat conductivity equivalent to that of the former two). The material (hereinafter referred to as "Cu core and the like") is coated with Ni alloy. The Cu core and the like and the Ni alloy coating contribute to reduction in temperature, to thereby secure durability of the central electrode and/or the ground electrode.

Forming the Cu core and the like in the ground electrode for improving durability, however, reduces the temperature of the ground electrode attributable to thermal conduction. Although durability is secured, the ground electrode will cause reduction in temperature at high engine speed. Moreover, such reduction in temperature is seen even at intermediate engine speed and at low engine speed. Contacting the ground electrode that is reduced in temperature, flame kernel (generated during spark plug discharge) is likely to be extinguished. In other words, ignitability is deteriorated.

Moreover, another method for improving the durability of the ground electrode is taken into account. More specifically, use of another material for the ground electrode, which material is higher in heat resistance (strength). Included in the another material is, for example, a super heat resisting alloy and the like. Use of such another material, however, involves increase in ordinary temperature resistance (strength), and thereby involves deterioration in plastic machinability (bendability). Therefore, when the ground electrode (made of the another material) is bent, for example, in such a manner that a side face of the ground electrode faces the central electrode, plastic machinability (bendability) of the ground electrode is of difficulty. The difficulty in plastic machinability (bendability) is responsible for reduction in productivity.

BRIEF SUMMARY OF THE INVENTION

It is therefore an object of the present invention to provide a spark plug that is used for an internal combustion engine at high engine speed, and that is excellent in durability and ignitability.

It is another object of the present invention to provide a method of producing the above mentioned spark plug.

According to a first aspect of the present invention, there is provided a spark plug comprising: a central electrode; an insulator surrounding the central electrode radially; a metallic shell surrounding the insulator radially; and a ground electrode having a first end connected to the metallic shell and a second end defining a side face. The ground electrode is so bent that the side face of the second end faces the central electrode. The ground electrode contains: a nickel in a range from 58% to 71% by weight, a chromium in a range from 21% to 25% by weight, an iron in a range from 7% to 20% by weight, and an aluminum in a range from 1% to 2% by weight. The ground electrode has a Vickers hardness in a range from Hv 140 to Hv 220 measured through a Vickers hardness test specified in Japanese Industrial Standard Z2244. A load 9.8 N is applied to the ground electrode in the Vickers hardness test.

According to a second aspect of the present invention, there is provided a method of producing a spark plug having a central electrode; an insulator surrounding the central electrode radially; a metallic shell surrounding the insulator radially; and a ground electrode having a first end connected to the metallic shell and a second end defining a side face. The ground electrode is so bent that the side face of the second end faces the central electrode. The method comprises the following sequential operations of: preparing the ground electrode composed of an alloy material, annealing the alloy material of the ground electrode at an annealing temperature not lower than 800° C., so as to allow the alloy material of the ground electrode to have a Vickers hardness in a range from Hv 140 to Hv 220 measured through a Vickers hardness test specified in Japanese Industrial Standard Z2244; welding the ground electrode to the metallic shell; and bending the ground electrode in such a manner as to allow the side face of the second end of the ground electrode to face the central electrode. The alloy material composing the ground electrode at the preparation contains: a nickel in a range from 58% to 71% by weight, a chromium in a range from 21% to 25% by weight, an iron in a range from 7% to 20% by weight, and an aluminum in a range from 1% to 2% by weight. A load 9.8 N is applied to the ground electrode in the Vickers hardness test.

A spark plug under the present invention has a ground electrode composed of an alloy containing Ni 58% to 71% by weight, Cr 21% to 25% by weight, Fe 7% to 20% by weight, and Al 1% to 2% by weight. Thereby, the ground electrode secures sufficient durability at high temperature. The thus obtained ground electrode is preferably used for a combustion chamber at high temperature caused by high engine speed of the internal combustion engine.

Moreover, conventionally, improvement in high temperature durability (namely, heat resistance, oxidation resistance, and the like) occasionally deteriorates plastic machinability (bendability) of the alloy. Vickers hardness (Hv 140 to Hv 220) of the ground electrode under the present invention, however, features a good plastic machinability (bendability). Therefore, even when the ground electrode is bent in such a manner that a side face of the ground electrode faces a central electrode, plastic machining (bending) of the ground electrode is easy. The easy plastic machining (bending) is expected to contribute to improvement in productivity.

Vickers hardness higher than Hv 220 makes the alloy (composing the ground electrode) too hard, to thereby make it unfavorably difficult to bend the ground electrode. Moreover, annealing is carried out for improving bendability. In this case, however, annealing the ground electrode to such an extent as higher than Hv 220 in hardness requires annealing condition for about 800° C. This temperature causes deposition of carbide on the grain boundary, to thereby deteriorate toughness. As a result, the ground electrode may cause minor cracks and the like during bending operation. With the cracks, the electrode may cause an unfavorable breakage attributable to vibrations and the like caused when the spark plug is used.

Contrary to the above, obtaining Vickers hardness lower than Hv 140 requires the annealing temperature as high as 1150° C. This temperature is responsible for remarkable grain growth, to thereby cause grain corrosion attributable to S, Pb and the like. As a result, the ground electrode is likely to be broken. Moreover, some of the after-mentioned methods of producing the spark plug are not capable of producing the ground electrode with ease.

The ground electrode is more preferably has Vickers hardness in a range from Hv 160 to Hv 200.

Obtaining the above Vickers hardness (Hv 140 to Hv 220) of the ground electrode requires annealing, at not lower than 800° C., the alloy that contains the above elements (Ni 58% to 71% by weight, Cr 21% to 25% by weight, Fe 7% to 20% by weight, and Al 1% to 2% by weight). Heating and keeping the ground electrode at not lower than 800° C. softens the alloy, to thereby allow the ground electrode to have Vickers hardness from Hv 140 to Hv 220. The thus obtained Vickers hardness is preferable for bending operation. Too high annealing temperature, however, may cause failures such as enlargement of the crystal grain, shedding (drop) and cracks. Therefore, the annealing temperature has an upper limit 1150° C.

The annealing temperature higher than 1150° C. excessively promotes the grain growth of the alloy composing the ground electrode, and thereby the alloy is likely to be broken.

Contrary to this, the annealing temperature lower than 800° C. is not sufficient for annealing the alloy. Therefore, preferable hardness (Hv 140 to Hv 220) is not provided for the ground electrode. Especially, keeping at annealing temperature 700° C. to 800° C. for a long time causes unfavorable deposition of carbide on the grain boundary. Thereby, the alloy is likely to be brittle. Further brittleness of the alloy causes the bent portion (formed during bending operation of the ground electrode) of the ground electrode to assume minor cracks. To further control the deposition of the carbide on the grain boundary, the annealing temperature is preferably set at not lower than 850° C.

For controlling formation of the carbide (responsible for brittle alloy), increased cooling speed at 700° C. to 800° C. is preferable. More specifically, the annealing should be carried out in the manner described in the following one sentence: An alloy wire or an alloy band (the two kinds of alloy are hereinafter referred to as alloy material), which is a material of the ground electrode, is fed into a cylindrical (or pipe) annealing furnace at a constant feed speed. In the above annealing manner, the alloy material soon after passing through the above cylindrical annealing furnace is cooled faster than the one through an ordinary annealing furnace. The above increased cooling speed contributes to control of the deposition of the carbide on the grain boundary. Furthermore, the control of the carbide deposition prevents embrittlement of the alloy, to thereby prevent breakage and the like of the ground electrode. Varying length of the cylindrical furnace or the feed speed of the alloy material adjusts the annealing (keeping) period, cooling speed and the like.

Under the present invention, the ground electrode is improved in durability, leaving no need for measures to improve corrosion resistance. As a result, good ignitability is secured. For example, the spark plug under the present invention is unlikely to need for embedment of Cu core and the like (that is used for improving durability) into the ground electrode.

A conventional ground electrode is occasionally broken due to heat history (thermal hysteresis) attributable to fluctuation in temperature in the combustion chamber, when the conventional ground electrode is used in the internal combustion engine that is operated frequently at high speed.

Contrary to the above, the ground electrode used for the spark plug under the present invention has the alloy that is excellent in heat resistance. Composing the ground electrode with the above alloy is effective for preventing failures such as breakage.

For preventing the ground electrode from breakage, the ground electrode is composed of the alloy containing the above elements (Ni 58% to 71% by weight, Cr 21% to 25% by weight, Fe 7% to 20% by weight, and Al 1% to 2% by weight).

In addition, adopting the spark plug having the ground electrode in the following constitution contributes to the prevention of the breakage of the ground electrode: The ground electrode forms a peak end area extending, in an axial direction of the ground electrode, from a predetermined intermediate position to a peak end of the ground electrode. In the above constitution, the ground electrode is more reduced in cross section in the axial direction toward the peak end.

In the specification, "dimension of the axial cross section" of the ground electrode is defined in the following manner: 1. Draw two parallel external tangents to an outline of the axial cross section. The two parallel external tangents should not run across an internal portion of the outline of the axial cross section. 2. Select the external tangents having the most distant spacing.

The other objects and features of the present invention will become understood from the following description with reference to the accompanying drawings.

DETAILED DESCRIPTION OF THE EMBODIMENT

Hereinafter described are embodiments under the present invention with reference to accompanying drawings.

Figure 1:
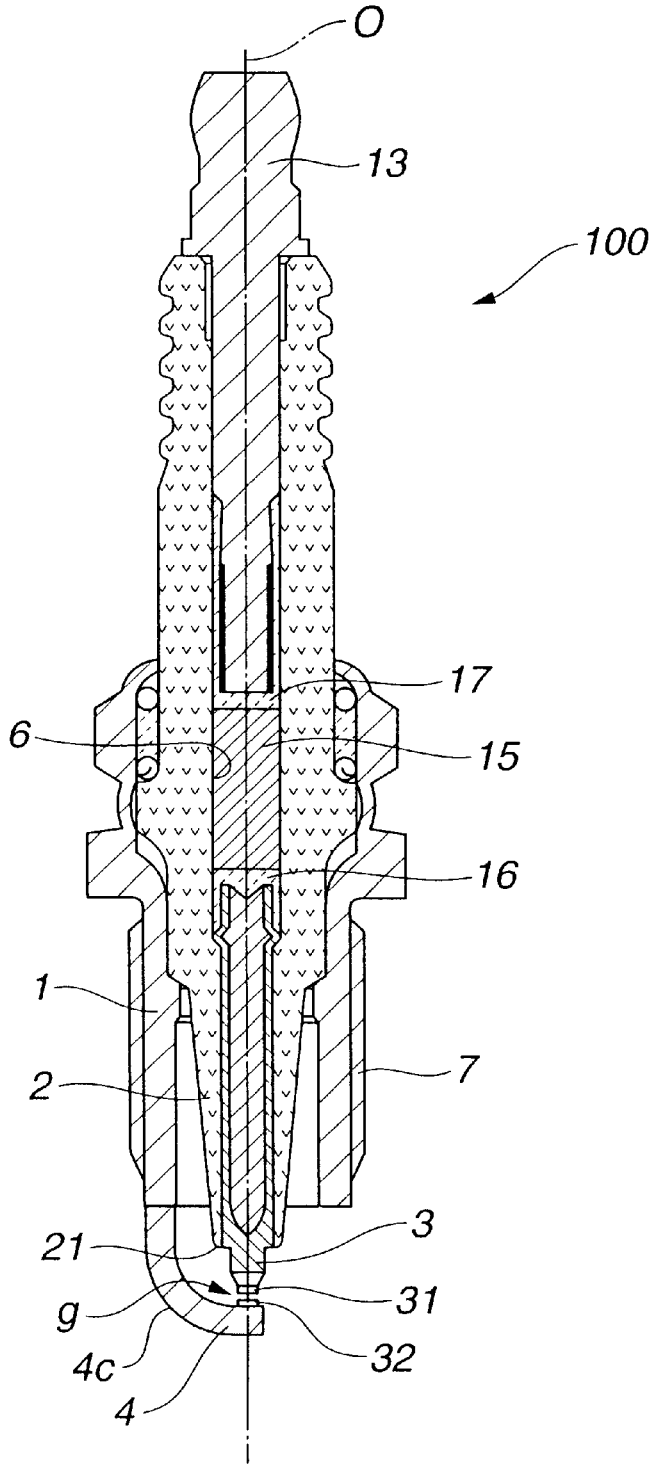
FIG. 1 is a front view showing a cross section of an entire part of a spark plug 100, under the present invention.

FIG. 1 shows a longitudinal cross section of a spark plug 100 under the present invention. The spark plug 100 incorporates a resistor. The spark plug 100 is constituted of a metallic shell 1, an insulator 2, a central electrode 3, a ground electrode 4, and the like. The metallic shell 1 is a main fitting, and is shaped into a cylinder. The insulator 2 has an end portion 21, and is inserted into the metallic shell 1 in such a manner that the end portion 21 protrudes (downward in FIG. 1). The central electrode 3 has an end portion which is formed with a discharge portion 31. The central electrode 3 is disposed inside the insulator 2 in such a manner that the discharge portion 31 protrudes (downward in FIG. 1). The ground electrode 4 has a first end (upper in FIG. 1) connected to the metallic shell 1 through welding and the like. The ground electrode 4 has a second end (lower in FIG. 1) bent sideward in such a manner as to face the central electrode 3, to thereby form a bent portion 4*c*. The ground electrode 4 has a side face facing the end portion 21 of the insulator 2. Moreover, the ground electrode 4 is formed with a discharge portion 32 opposed to the discharge portion 31. There is formed a spark discharge gap g between the discharge portion 31 and the discharge portion 32. At least one of the discharge portion 31 and the discharge portion 32 is allowed to be removed (omitted).

The insulator 2 is made of sintered ceramic such as alumina, aluminum nitride, and the like. For mating with the central electrode 3 in an axial direction of the insulator 2, the insulator 2 forms therein a through hole 6. The metallic shell 1 is cylindrical in shape, and is made of metal such as low carbon steel and the like. Moreover, the metallic shell 1 constitutes a housing of the spark plug 100, and has an external periphery forming a screw section 7 for mounting the spark plug 100 on an engine block (not shown). The through hole 6 has a first end (upper in FIG. 1) for inserting therein a terminal metal fitting 13 for fixation, and a second end (lower in FIG. 1) for inserting therein the central electrode 3 for fixation. In the through hole 6, there is disposed a resistor 15 between the terminal metal fitting 13 and the central electrode 3. The resistor 15 has a first end (upper in FIG. 1) electrically connected, by way of a conductive glass seal layer 17, to the terminal metal fitting 13, and a second end (lower in FIG. 1) electrically connected, by way of a conductive glass seal layer 16, to the central electrode 3.

The ground electrode 4 contains Ni 58% to 71% by weight, Cr 21% to 25% by weight, Fe 7% to 20% by weight, and Al 1% to 2% by weight. The ground electrode 4 has Vickers hardness Hv 140 to 220 with an applied load of 9.8 N in Vickers hardness test specified by JIS-Z2244 (1992) (JIS stands for Japanese Industrial Standard). Other than the added elements described above, the ground electrode 4 is allowed to contain C not higher than 0.1% by weight, Si not higher than 0.5% by weight, Mn not higher than 1% by weight, and Ti not higher than 0.5% by weight.

Described hereinafter are causes for defining the ranges of content (%) of respective four added elements (Ni, Cr, Fe, and Al) which are indispensable under the present invention.

1. Ni: 58% to 71% by weight

Ni a fundamental element of a heat resisting alloy which is preferably used for the ground electrode. At high temperature, Ni is indispensable for securing strength and corrosion resistance. Therefore, Ni should be not lower than 58% by weight. When Ni is lower than 58% by weight, sufficient durability is not secured at high temperature in relation to content of other added elements. On the contrary, considering a minimum content of the other indispensable added elements, added Ni should not exceed 71% by weight (or physically impossible).

2. Cr: 21% to 25% by weight

Cr improves corrosion resistance of alloy, attributable to passive effect. In addition, solid solution of Ni and Cr contributes to harder alloy. Thereby, Cr is preferably not lower than 21% by weight. When Cr is lower than 21% by weight, corrosion resistance is not secured due to grain boundary corrosion and the like attributable to sensitization. On the contrary, adding too much Cr will decrease heat conductivity, to thereby allow the alloy to be heated. Therefore, Cr is preferably not higher than 25% by weight.

3. Fe: 7% to 20% by weight

Fe causes solid solution with Ni and/or Cr, to thereby form a heat resisting alloy at high temperature with excellent durability. For securing heat resisting property of the alloy, Cr should be not lower than 7% in relation to content of other added elements that are indispensable. Contrary to this, when Cr is higher than 20% by weight, Ni content and/or Cr content is relatively lower, to thereby deteriorate corrosion resistance.

4. Al: 1% to 2% by weight

For contribution to improved corrosion resistance, Al is preferably not lower than 1%. Al lower than 1% by weight is not sufficient for securing improved corrosion resistance. Contrary to this, too much Al may form compound with other elements, to deteriorate plastic machinability (bendability). Therefore, Al should be controlled not higher than 2% by weight.

In addition to the above four added elements (Ni, Cr, Fe, and Al) that are indispensable, described hereinafter are other elements.

5. C: 0.01% to 0.1% by weight

C encourages deposition, to thereby improve hardness of alloy. C should be not lower than 0.01% by weight for securing high temperature strength. When C is higher than 0.1% by weight, however, excessive carbide is likely to deposit during annealing. The excessive carbide deteriorates toughness. The carbide is mainly a compound with Cr. In other words, Cr for required forming oxide film is wasted. Therefore, adding C higher than 0.1% by weight is disadvantageous for oxidation resistance.

6. Si: 0.1% to 0.5% by weight

Si is expected to improve oxidation resistance and corrosion resistance. Therefore, preferred Si is not lower than 0.1% by weight. However, Si reduces plastic machinability (bendability). Therefore, Si is preferably not higher than 0.5% by weight.

7. Mn: 0.1% to 1.0% by weight

Like Al and Cr, Mn is an element that is effective for improving corrosion resistance (especially, sulfur resistance). Therefore, preferable Mn is not lower than 0.1% by weight. However, Mn also reduces plastic machinability (bendability). Therefore, Mn is preferably not higher than 1.0%.

8. Ti: 0.05% to 0.5% by weight

Ti ordinarily forms compound with N in the material, to thereby deposit on the grain boundary and the like. The deposition controls crystal grain from becoming large. Large crystal grain may cause cracks attributable to crystal boundary corrosion and concentrated stress. For preventing the concentrated stress, the crystal grain should be controlled from becoming large. Thereby, added Ti is not lower than 0.05% by weight. However, Ti accelerates internal oxidation. Therefore, Ti should be not higher than 0.5% by weight.

9. Mo and W

Other elements such as Mo, W and the like are allowed to be added to the ground electrode 4, for improving corrosion resistance. Addition of Mo, W and the like reinforces passivity state, to thereby improve corrosion resistance. On the contrary, too much addition of Mo, W and the like will excessively harden the alloy, to thereby deteriorate plastic machinability (bendability) of the alloy. The above summarizes that the addition of Mo, W and the like should be properly controlled.

10. Mg, P, S, Cu, and Co

Other than the elements described above, Mg, P, S, Cu, Co and the like are, as the case may be, contained as impurity during forming Ni. Of the above impurities, P and S deteriorate plastic machinability (bendability). Therefore P content and S content should be controlled. More specifically, P is preferably controlled not higher than 0.03% by weight, while S is preferably controlled not higher than 0.015% by weight. On the other hand, content of each of Mg, Cu and Co does not require intentional control. In this case, however, Mg, Cu, Co are preferably so controlled that total impurities (namely, C, Si, Mn, Ti, Mo, W, Mg, P, S, Cu, Co, and the like) are not higher than 3% by weight. With this, content of the main elements (Ni, Cr, Fe and Al) is sufficiently secured for required property of the alloy.

Figure 2:
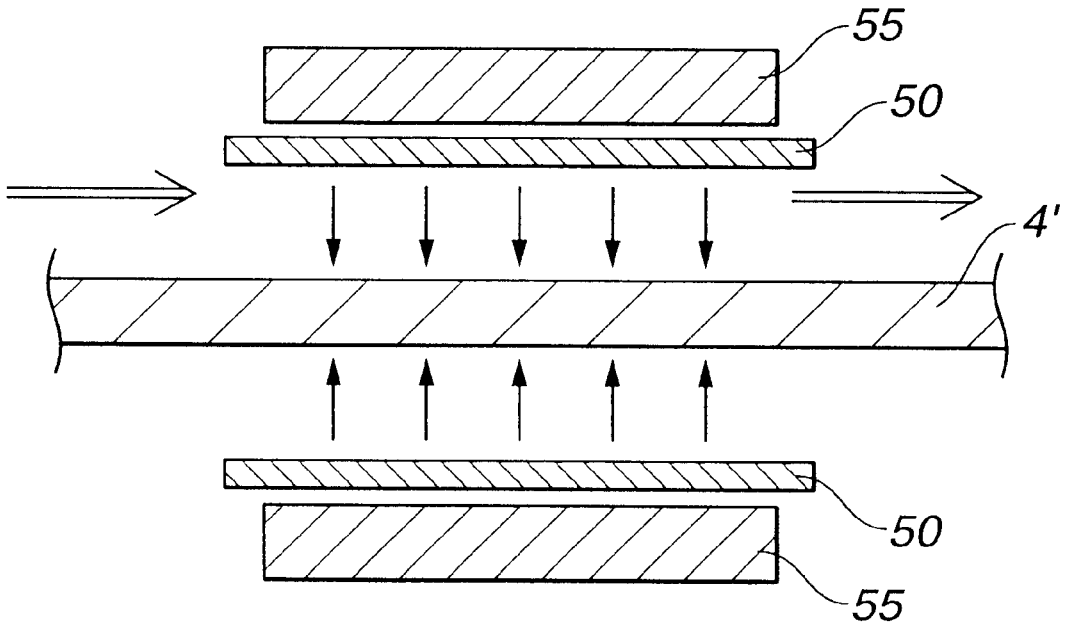
FIG. 2 is a modeled method of producing the spark plug, under the present invention.

The ground electrode 4 having the above described content is subjected to the following heat treatment (annealing) so as to secure preferred hardness:

The heat treatment is carried out, for example, in a manner of a pipe annealing. FIG. 2 shows a modeled process of annealing an alloy material 4' in the manner of the pipe annealing. As is seen in FIG. 2, the alloy material 4' is fed in a cylindrical annealing furnace 50 at a predetermined rate. Herein, the annealing furnace 50 is heated by means of a heating means 55 such as a heater, a high frequency induction coil and the like. Heat of the annealing furnace 50 is so adjustable to obtain a required annealing temperature. The annealing temperature is controlled not lower than 800° C. Rate of cooling the alloy material 4' is preferably controlled by adjusting rate of feeding the alloy material 4, to thereby prevent the alloy material 4' from forming unfavorable carbide. In addition, other known annealing method is allowed, provided that the known annealing method is capable of producing the alloy material 4' having required Vickers hardness (Hv 140 to Hv 220).

With the annealing carried out, the alloy material 4' has a preferred hardness. The thus obtained alloy material 4' is cut into proper dimension for the ground electrode 4. After the cutting, the alloy material 4' is mounted to the metallic shell 1 in a known welding method such as resistance welding, laser welding and the like, to thereby form the ground electrode 4. Then, the ground electrode 4 is so bent at the bent portion 4*c* (refer to FIG. 1 and the like) that a side face of a peak end area 41 {see FIG. 4(*a*) and FIG. 4(*b*)} of the ground electrode 4 thus mounted on the metallic shell 1 faces the central electrode 3. After the bending operation of the ground electrode 4, the spark plug 100 is formed. Bending operation of the ground electrode 4 is carried out in a known method. Herein, the ground electrode 4 has Vickers hardness Hv 140 to Hv 220. Therefore, bending operation of the ground electrode 4 is easy. Moreover, the annealing without causing unfavorable carbide deposition controls any cracks and the like which may be caused at the bent portion 4*c* of the ground electrode 4.

Moreover, the ground electrode 4 having the above content has an improved durability at high temperature. Therefore, an effectiveness is seen especially when the ground electrode 4 used for the spark plug 100 is likely to get high in temperature, which is conventionally deemed troublesome in terms of durability.

Figure 3:
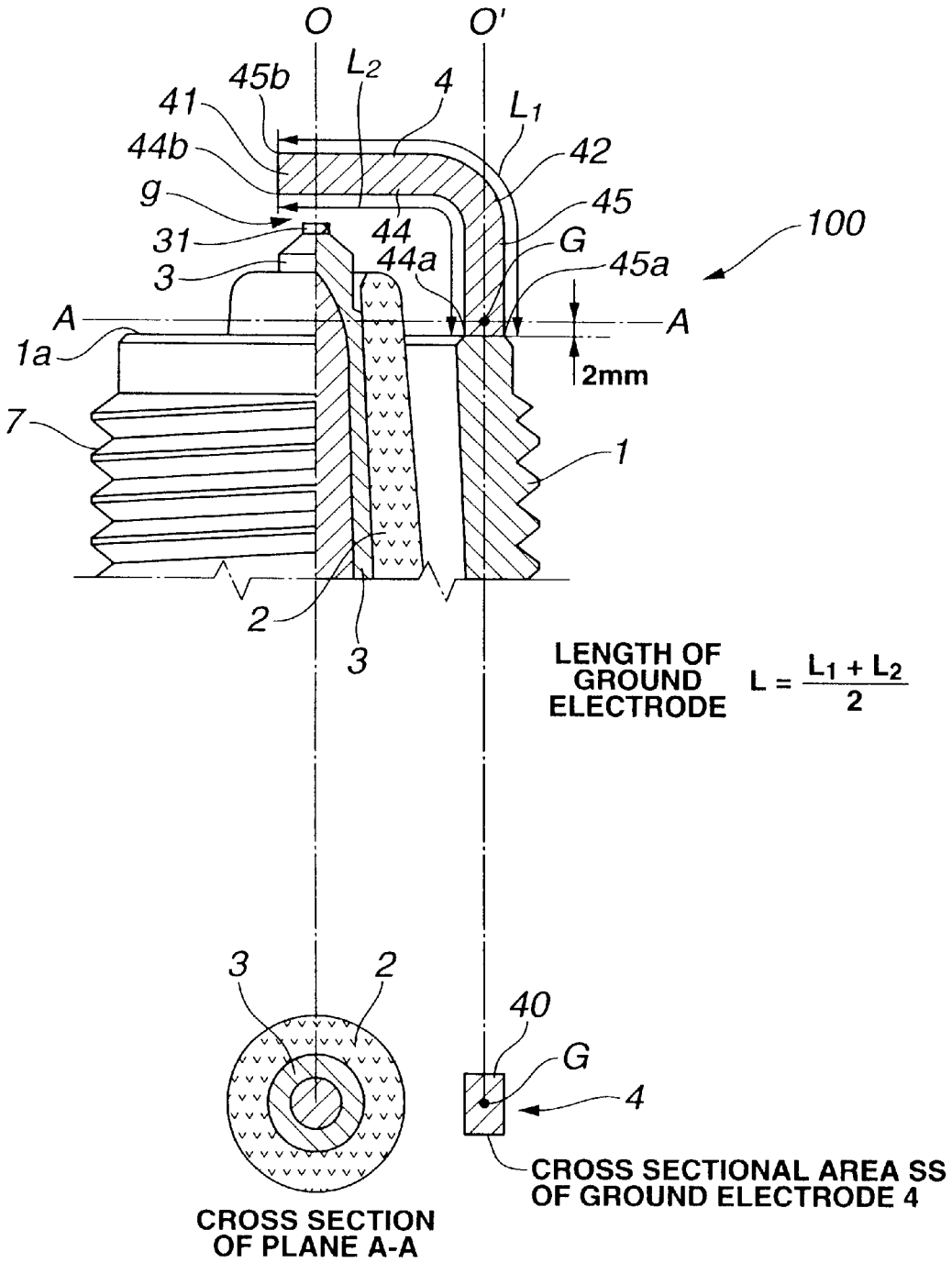
FIG. 3 shows the spark plug 100 having a length L of a ground electrode 4 and a cross sectional area SS of a cross section 40 of the ground electrode 4.

According to the embodiment of the present invention, the ground electrode 4 is machined into the following configuration with which the ground electrode 4 is likely to get high in temperature:

More specifically, as is seen in FIG. 3, a plane A—A is distant by 2 mm from an end face 1*a* of the metallic shell 1 toward the spark discharge gap g in an axial direction of the central electrode 3. Herein, the plane A—A is vertical to an axis O of the central electrode 3. The plane includes a cross section 40 corresponding to the ground electrode 4. The cross section 40 has a cross sectional area SS ($mm^2$).

The cross section 40 defines a geometric gravity center G. Through the geometric gravity center G, a reference axis O' is assumed to be aligned in parallel with the axis O of the central electrode 3.

There is provided the following assumption: The ground electrode 4 is orthographically projected to an imaginary plane (hereinafter referred to as "side face view") which is in parallel with a plane including the reference axis O' and the axis O. The orthographical projection forms an outline of the spark plug 100 including the ground electrode 4.

Hereinafter described is in terms of the outline of the orthographical projection of the ground electrode 4:

A first length L1 and a second length L2 are defined as follows: There are shown two side peripheries. One side periphery faces the central electrode 3, while the other side periphery is disposed opposite. Hereinafter, the one side periphery is referred to as a second periphery 44, while the other side periphery 45 is referred to as a first periphery 45. There is provided a first connection 45*a* connecting the metallic shell 1 with the ground electrode 4. Along the first periphery 45, the length L1 extends from the first connection 45*a* to a first peak end 45*b*. There is provided a second connection 44*a* connecting the metallic shell 1 with the ground electrode 4. Along the second periphery 44, the length L2 extends from the second connection 44*a* to a second peak end 44*b*.

A ground electrode length L (mm) is defined as an arithmetic mean of the first length L1 and the second length L2. More specifically, L=(L1+L2)/2. Then, the following condition is laid down:

$$1.5 \leqq L/SS \leqq 4.39 \text{ (1/mm)} \qquad \text{Condition 1}$$

When the cross sectional area SS ($mm^2$) is small, the heat once stored in the ground electrode is not preferably conducted (namely, uncomfortable thermal conduction), to thereby heat up the ground electrode. In addition, when the ground electrode length L is long, the ground electrode protrudes more into the combustion chamber, to thereby increase the ground electrode in temperature. The above two cases summarize that the larger the L/SS (1/mm) is, the more worn the ground electrode is. This phenomenon is especially outstanding when L/SS≧1.5. When the L/SS is too large, however, the cross sectional area SS is relatively small, to thereby cause breakage and the like of the ground electrode. The L/SS lager than 4.39 is not preferred since the ground electrode is not preferable in terms of configuration. As a result, L/SS is preferably ≦L/SS 4.39.

Figure 4A:
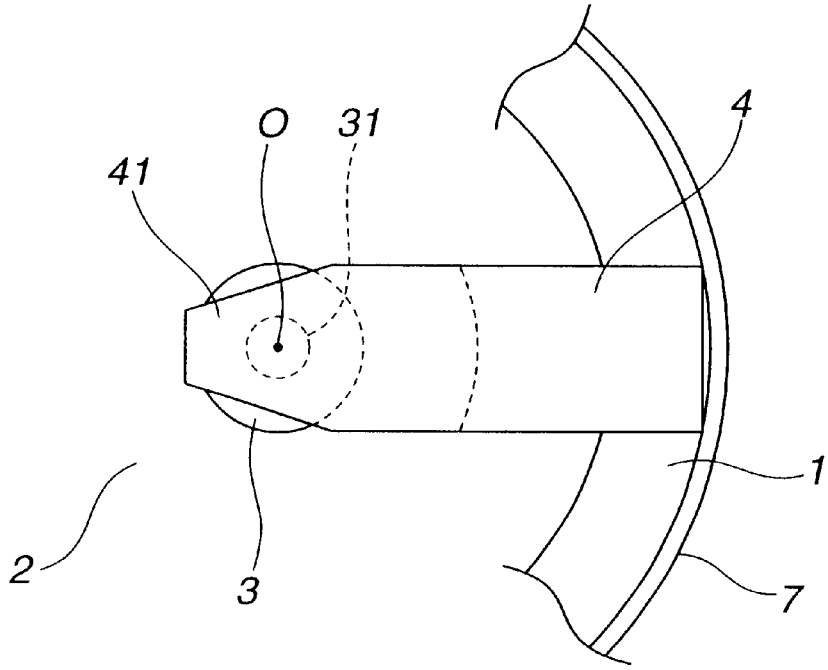
FIG. 4 shows a configuration of an end portion of the ground electrode 4, in which, FIG. 4(*a*) shows a front view of the ground electrode 4, and FIG. 4(*b*) shows a side view of the ground electrode 4.
Figure 4B:
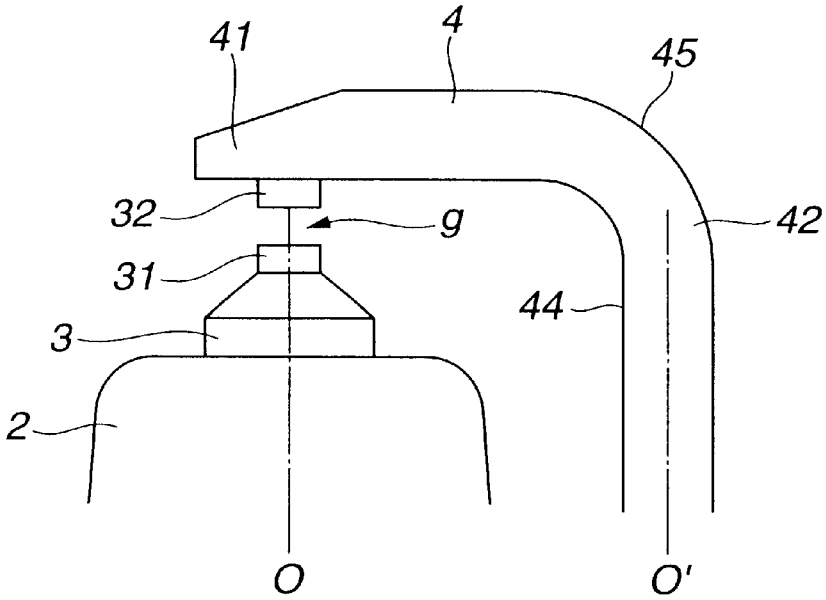

Moreover, according to the embodiment, as is seen in FIG. 4(*a*), the ground electrode 4 is so formed as to get narrower toward an peak end thereof {leftward in FIG. 4(*a*)} when the ground electrode 4 is viewed, in front view, along the central axial O of the central electrode 3. With the peak end area 41 thus formed on the ground electrode 4, the ground electrode 4 is relatively reduced in volume and the peak end area 41 is reduced in weight. Thereby, a stress applied to the bent portion 4*c* of the ground electrode 4 is reduced. More in detail, the stress is the one that is caused by a vibration of the ground electrode 4 when the spark plug 100 is used. With the thus reduced stress, the ground electrode 4 is prevented from breakage.

Reduction of the peak end area 41 of the ground electrode 4 is also made in the following manner. FIG. 4(*b*) shows a side view of the ground electrode 4. As the first periphery 45 approaches the peak end area 41 of the ground electrode 4, the first periphery 45 gets nearer to the second periphery 44. In this case, however, the second periphery 44 (namely, the side facing the central electrode 3) preferably keeps flat in the peak end area 41 of the ground electrode 4. With the above configuration, the spark discharge gap g between the central electrode 3 and the ground electrode 4 is controlled from being large, to thereby keep a preferable spark discharge.

Moreover, at least one of the central electrode 3 and the ground electrode 4 of the spark plug 100 is allowed to mount a precious metal chip forming respectively the discharge portion 31 and the discharge portion 32. More specifically, the precious metal is the one that is composed of main element of one of Ir and Pt for securing good durability. The above precious metal chip is adhered to a predetermined position of one of the respective central electrode 3 and ground electrode 4 through resistor welding, laser welding and the like.

EXAMPLES

The following experiments were carried out for checking effect of the present invention:

To prepare the ground electrode of the spark plug, Inconel 601 (alloy having the content under the present invention) was used as the embodiment, while Inconel 600 was used for a comparison. Each of Inconel 601 and Inconel 600 is an alloy and a brand of INCO in England.

1. An alloy body of each of Inconel 601 and Inconel 600 was subjected to hot forging and hot wire drawing, so as to be formed into an alloy material in accordance with a desired ground electrode.
2. The alloy material of each of Inconel 601 and Inconel 600 was prepared plural in number.
3. The alloy material of each of Inconel 601 and Inconel 600 was subjected to a pipe annealing under the conditions shown in Table 1.
4. Each of the alloy materials was cut into a predetermined dimension, to thereby prepare the ground electrode.
5. Each of the ground electrodes thus prepared was subjected to the Vickers hardness test specified by JIS-Z2244 applying a load (9.8 N) by means of a micro Vickers hardness tester.

Moreover, the following table burner test was carried out on the ground electrode prepared in the above manners:

1. The peak end area of the thus formed ground electrode was heated with a burner.
2. Kept at rest for two minutes.
3. Cooled for one minute.

Above 1 to 3 is defined as one cycle of the table burner test.

20,000 cycles were carried out.

Figure 5:
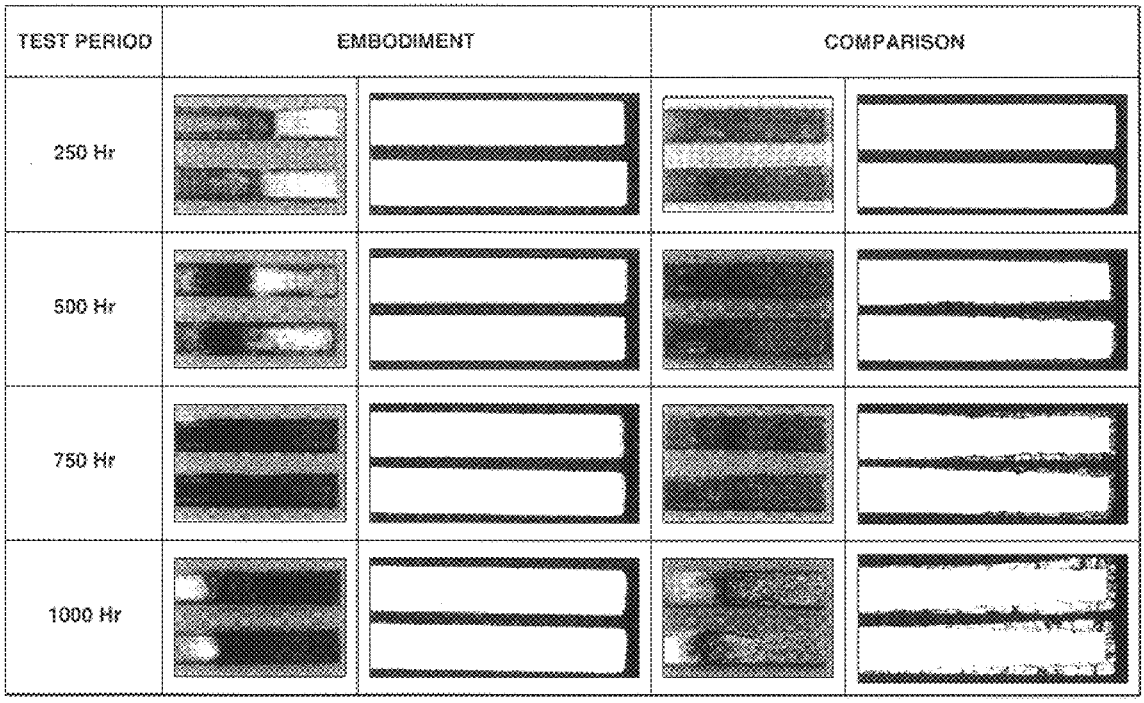
FIG. 5 shows results of a table burner test on the ground electrode, according to the example.

The ground electrode of each of Inconel 601 and Inconel 600 after the table burner test was observed with a magnifying glass. FIG. 5 shows the ground electrodes (annealed at 1080° C. for 1.5 minutes) after the table burner test. Degree of corrosion was checked through visual inspection. Two inspection criteria are defined as follows:

OK: Ground electrode with substantially no corrosion.

NG (no good): Ground electrode with progressive corrosion.

Each of the ground electrodes obtained under the respective annealing conditions was bent and mounted on the metallic shell, to thereby prepare the spark plug. Herein, the bent portion of the ground electrode after the bending operation was observed with a magnifying glass, so as to check for any minor cracks. Dimensions of outline of the cross section 40 of the ground electrode 4 in FIG. 3 are defined as follows: 2.8 mm long, and 1.6 mm wide. Moreover, the L/SS=2.9.

Moreover, the following engine durability test was carried out on each of the spark plugs:

The spark plug was mounted on a gasoline engine (displacement 2000 cc, 6-cylinder).

Conditions for engine durability test:

a. Full open throttle, engine speed 5000 rpm, and operation period: 1 minute.
b. Idling, operation period: 1 minute.

Cumulative operation period: 100 hours and 175 hours.

After the engine durability test, the central electrode was 950° C. to 970° C.

Figure 6:
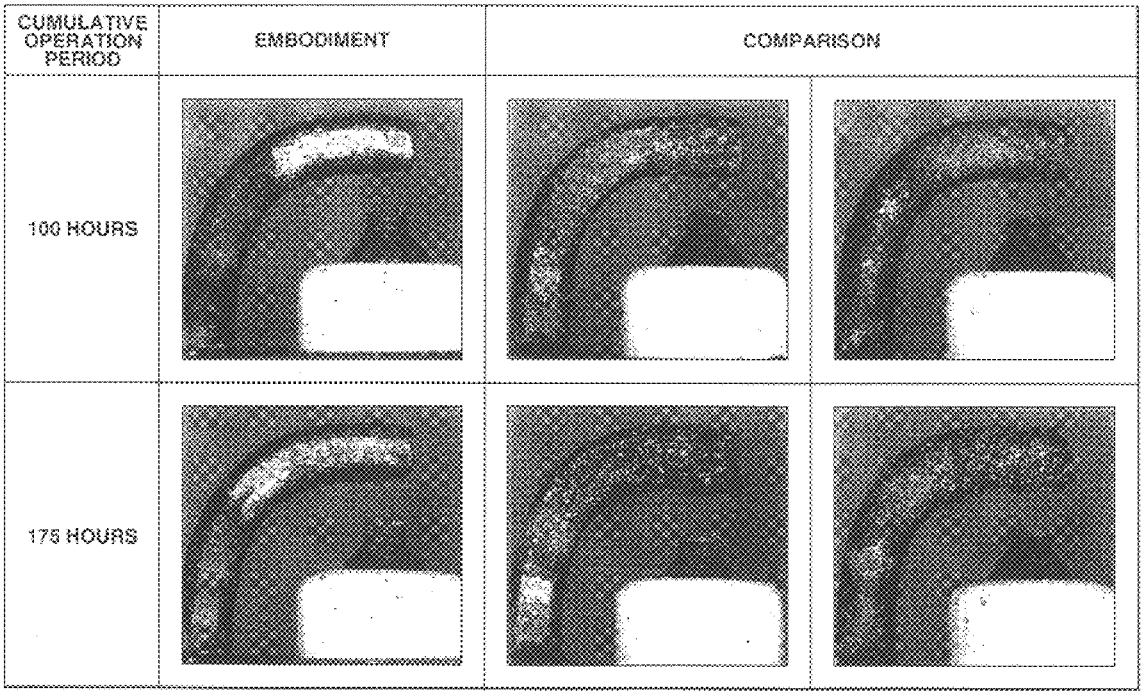
FIG. 6 shows the ground electrode after an engine durability test, according to the example.

Then, the ground electrode after the engine durability test was observed with the magnifying glass. FIG. 6 shows an observation of the ground electrode (annealed at 1080° C. for 1.5 minutes). The ground electrode was subjected to the visual inspection. Three inspection criteria are defined as follows:

A: Substantially no corrosion observed.

B: Corrosion observed on grain boundary.

C Worn out due to corrosion.

The evaluation results are summed up in Table 1.

TABLE 1

| Alloy composition | Inconel 601 (brand) | | | | | | | Inconel 600 (brand) |
|---|---|---|---|---|---|---|---|---|
| Annealing temperature (° C.) | 1185 | 1130 | 1080 | 1050 | 1000 | 960 | 800 | 1080 |
| Hardness (Hv) | 120 | 140 | 160 | 180 | 200 | 220 | 300 | 150 |
| Results of table burner test | Not available | A | A | A | A | A | Not available | C |
| Crack found at bent portion? | Not available | No. | No. | No. | No. | No. | Yes. | Not available |

TABLE 1-continued

| Alloy composition | Inconel 601 (brand) | | | | | | | Inconel 600 (brand) |
|---|---|---|---|---|---|---|---|---|
| Results of engine durability test | B | A | A | A | A | A | Not available | C |

According to Table 1, the method of producing the spark plug under the present invention brings about the following effects:

Conventionally, Inconel 601 was not preferably used as an alloy material composing the ground electrode due to its Vickers hardness. With the method of producing spark plug under the invention, however, the Inconel 601 is preferable in terms of hardness for the ground electrode that is subjected to bending operation. Moreover, with the method producing spark plug under the present invention, the bent portion of the ground electrode is free from any cracks and the like which may be caused after the bending operation.

Figure 7:
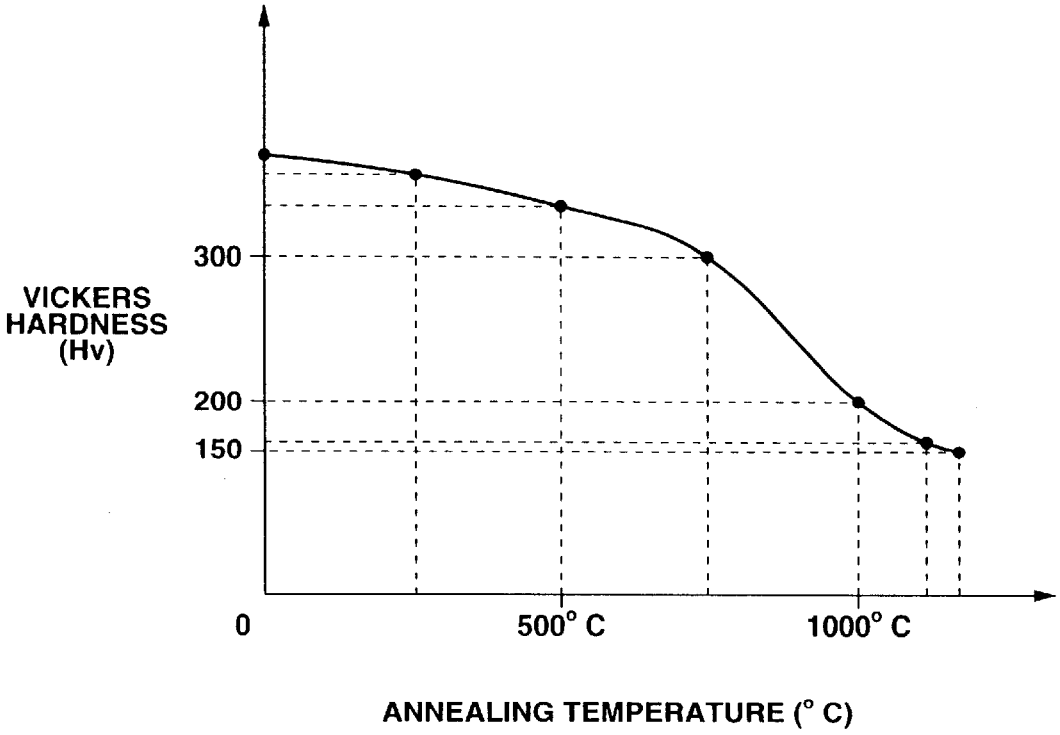
FIG. 7 is a graph showing Vickers hardness (Hv) of the ground electrode relative to annealing temperature (° C.).

FIG. 7 shows Vickers hardness (Hv) relative to annealing temperature (° C.), substantially supporting the above mentioned effect of the present invention.

Moreover, according to the embodiment, the fact that the ground electrode uses the alloy material (Inconel 601) that is composed of the material under the present invention brings about the following effects to the spark plug:

1. The ground electrode is improved in durability.
2. The ground electrode features good corrosion resistance even when the temperature in the combustion chamber is high or likely to fluctuate.

Although the present invention has been described above by reference to certain embodiments, the present invention is not limited to the embodiments described above. Modifications and variations of the embodiments described above will occur to those skilled in the art, in light of the above teachings.

According to the embodiment described above, the ground electrode is free of any core material. The present invention is, however, not limited to the above. More specifically, the ground electrode is allowed to incorporate a core material made of metal (for example, Cu) that is more excellent in heat conductivity than a metal of a "surface layer (see the second following sentence)" of the ground electrode. In this case, however, the ground electrode should meet a minimum requirement of being composed of the metal under the present invention (Ni in a range from 58% to 71%, Cr in a range from 21% to 25%, Fe in a range from 7% to 20%, and Al in a range from 1% to 2%). The above minimum requirement should be met at least on the surface layer of the ground electrode. With the metal (on the surface layer) that is excellent in durability at high temperature, thinning the core material (thinner than the conventional one) prevents flame extinction.

The entire contents of basic Japanese Patent Application No. P2001-053845 (filed on Feb. 28, 2001) of which priority is claimed is incorporated herein by reference.

The scope of the present invention is defined with reference to the following claims.

What is claimed is:

1. A spark plug comprising:

a central electrode;

an insulator surrounding the central electrode radially;

a metallic shell surrounding the insulator radially; and a ground electrode having a first end connected to the metallic shell and a second end defining a side face, the ground electrode being so bent that the side face of the second end faces the central electrode, the ground electrode containing:

a nickel in a range from 58% to 71% by weight, a chromium in a range from 21% to 25% by weight, an iron in a range from 7% to 20% by weight, and an aluminum in a range from 1% to 2% by weight, in which the ground electrode has a Vickers hardness in a range from Hv 140 to Hv 220 measured through a Vickers hardness test specified in Japanese Industrial Standard Z2244, a load 9.8 N being applied to the ground electrode in the Vickers hardness test.

2. The spark plug as claimed in claim 1, in which the ground electrode further contains:

a carbon not higher than 0.1% by weight, a silicon not higher than 0.5% by weight, a manganese not higher than 1% by weight, and a titanium not higher than 0.5% by weight.

3. The spark plug as claimed in claim 2, in which the ground electrode contains:

the carbon in a range from 0.01% to 0.1% by weight, the silicon in a range from 0.1% to 0.5% by weight, the manganese in a range from 0.1% to 1% by weight, and the titanium in a range from 0.05% to 0.5% by weight.

4. The spark plug as claimed in claim 1, in which the ground electrode is formed with a peak end area extending, in an axial direction of the ground electrode, from a predetermined intermediate position of the ground electrode to a peak end of the ground electrode; and the ground electrode is more reduced in cross section in the axial direction toward the peak end of the ground electrode.

5. The spark plug as claimed in claim 4, in which the ground electrode is more reduced in width toward a peak end of the ground electrode, when the ground electrode is viewed in a direction along an axis of the central electrode.

6. The spark plug as claimed in claim 4, in which the ground electrode is more reduced in thickness toward a peak end of the ground electrode with the side face facing the central electrode kept flat, when the ground electrode is viewed in a direction perpendicular to an axis of the central electrode.

7. The spark plug as claimed in claim 1, in which the metallic shell has an end face;

a spark discharge gap is formed, in a direction along an axis of the central electrode, substantially between the following two:

an end portion of the central electrode, and the side face of the second end of the ground electrode, facing the end portion of the central electrode;

the ground electrode has a cross sectional area in $mm^2$ on a plane perpendicular to the axis of the central electrode, the plane being distant by 2 mm from the end face of the metallic shell toward the spark discharge gap;

the cross sectional area of the ground electrode defines a geometric gravity center through which a reference axis passes, the reference axis being in parallel with the axis of the central electrode in such a manner as to form a plane;

the ground electrode is projected on an imaginary plane which is in parallel with the plane formed by the axis of the central electrode and the reference axis, to thereby form a projected outline;

the following two lengths on the projected outline of the ground electrode are measured for obtaining an arithmetic mean thereof in mm:

a first length extending from a first connection to a first peak end along a first periphery on a first side opposite to a second side facing the central electrode, the first connection connecting the ground electrode with the metallic shell, and a second length extending from a second connection to a second peak end along a second periphery on the second side facing the central electrode, the second connection connecting the ground electrode with the metallic shell; and the obtained arithmetic mean of the first length and the second length is divided by the cross sectional area, to thereby bring about a quotient in a range from 1.5 in 1/mm to 4.39 in 1/mm.

8. The spark plug as claimed in claim 1, in which the ground electrode has the Vickers hardness in a range from Hv 160 to Hv 200.

9. A spark plug comprising:

a central electrode;

an insulator surrounding the central electrode radially;

a metallic shell surrounding the insulator radially; and a ground electrode having a first end connected to the metallic shell and a second end defining a side face, the ground electrode being so bent that the side face of the second end faces the central electrode, at least a surface layer of the ground electrode containing:

a nickel in a range from 58% to 71% by weight, a chromium in a range from 21% to 25% by weight, an iron in a range from 7% to 20% by weight, and an aluminum in a range from 1% to 2% by weight, in which the at least the surface layer of the ground electrode has a Vickers hardness in a range from Hv 140 to Hv 220 measured through a Vickers hardness test specified in Japanese Industrial Standard Z2244, a load 9.8 N being applied to the ground electrode in the Vickers hardness test.

10. The spark plug as claimed in claim 9, in which the ground electrode incorporates a core material made of a metal having a heat conductivity higher than a heat conductivity of the at least the surface layer.

11. A ground electrode of a spark plug, the spark plug having a central electrode; an insulator surrounding the central electrode radially; and a metallic shell surrounding the insulator radially; the ground electrode having a first end connected to the metallic shell and a second end defining a side face, the ground electrode being so bent that the side face of the second end faces the central electrode, at least a surface layer of the ground electrode comprising:

a nickel in a range from 58% to 71% by weight, a chromium in a range from 21% to 25% by weight, an iron in a range from 7% to 20% by weight, and an aluminum in a range from 1% to 2% by weight;

in which the at least the surface layer of the ground electrode has a Vickers hardness in a range from Hv 140 to Hv 220 measured through a Vickers hardness test specified in Japanese Industrial Standard Z2244, a load 9.8 N being applied to the ground electrode in the Vickers hardness test.

12. The ground electrode of the spark plug as claimed in claim 11, in which the ground electrode incorporates a core material made of a metal having a heat conductivity higher than a heat conductivity of the at least the surface layer.

13. A method of producing a spark plug having a central electrode; an insulator surrounding the central electrode radially; a metallic shell surrounding the insulator radially; and a ground electrode having a first end connected to the metallic shell and a second end defining a side face, the ground electrode being so bent that the side face of the second end faces the central electrode; the method comprising the following sequential operations of:

preparing the ground electrode composed of an alloy material containing:

a nickel in a range from 58% to 71% by weight, a chromium in a range from 21% to 25% by weight, an iron in a range from 7% to 20% by weight, and an aluminum in a range from 1% to 2% by weight;

annealing the alloy material of the ground electrode at an annealing temperature not lower than 800° C., so as to allow the alloy material of the ground electrode to have a Vickers hardness in a range from Hv 140 to Hv 220 measured through a Vickers hardness test specified in Japanese Industrial Standard Z2244, a load 9.8 N being applied to the ground electrode in the Vickers hardness test;

welding the ground electrode to the metallic shell; and bending the ground electrode in such a manner as to allow the side face of the second end of the ground electrode to face the central electrode.

14. The method of producing the spark plug as claimed in claim 13, in which the annealing temperature is in a range from 800° C. to 1150° C.

15. The method of producing the spark plug as claimed in claim 14, in which the annealing temperature is in a range from 850° C. to 1150° C.

16. The method of producing the spark plug as claimed in claim 13, in which the Vickers hardness is in a range from Hv 160 to Hv 200.

* * * * *